US006670535B2

(12) United States Patent
Anderson et al.

(10) Patent No.: US 6,670,535 B2
(45) Date of Patent: Dec. 30, 2003

(54) MUSICAL-INSTRUMENT CONTROLLER WITH TRIAD-FORMING NOTE-TRIGGER CONVERGENCE POINTS

(76) Inventors: Clifton L. Anderson, 333 Cobalt Way, Ste 107, Sunnyvale, CA (US) 94085-5420; Zenon Q. Anderson, 3594 Sunnymead Ct., San Jose, CA (US) 95117

( * ) Notice: Subject to any disclaimer, the term of this patent is extended or adjusted under 35 U.S.C. 154(b) by 0 days.

(21) Appl. No.: 10/142,223

(22) Filed: May 9, 2002

(65) Prior Publication Data

US 2003/0209130 A1 Nov. 13, 2003

(51) Int. Cl.[7] ..... G10C 3/12
(52) U.S. Cl. ..... 84/443; 84/471 SR
(58) Field of Search ..... 84/443, 471 SR, 84/485 SR, 479 R, 479 A, 483.1, 483.2, 485 R

(56) References Cited

U.S. PATENT DOCUMENTS 5,415,071 A * 5/1995 Davies ..... 84/471 SR
5,440,071 A 8/1995 Johnson ..... 84/637
5,565,641 A 10/1996 Gruenbaum ..... 84/615
6,392,131 B2 * 5/2002 Boyer ..... 84/424
2001/0052283 A1 * 12/2001 Boyer ..... 84/443

OTHER PUBLICATIONS

"The Monolith Two–Dimensional MIDI Controller Keyboard" Web Pages www.electronic–mall.com/heavenbound dated Apr. 29, 2002, 5 pages.
"The Wilson Generalized Keyboards", Web pages downloaded from www.StarrLabs.com Apr. 29, 2002, 5 pages.
"*The ZBoard*" Web pages downloaded from www.StarrLabs.com on Apr. 29, 2002, 3 pages.
"*Surface One*" Web Pages downloaded from www.midiman-.com/products/midiman/sufaceone.php on May 6, 2002, 2 pages.
Rule, Greg, "Workspace" Keyboard Magazine, May 2002, San Mateo, California, p. 144.

* cited by examiner

*Primary Examiner*—Jeffrey Donels
(74) *Attorney, Agent, or Firm*—Clifton L. Anderson

(57) ABSTRACT

A musical instrument controller provides an array keyboard in which most note triggers form major 3rd, minor 3rd, and perfect fifth intervals at line segment boundaries with adjacent note triggers, and form major and minor triads at vertices or other convergence points where three note triggers meet. The segments and vertices provide for single-finger triggering of intervals and triads. After-pressure and movement in the array plane (even crossing trigger boundaries) provide for three dimensions of per-key continuous control.

6 Claims, 11 Drawing Sheets

| | | | | | | | | | | | |
|---|---|---|---|---|---|---|---|---|---|---|---|
| F | D | F# | Eb | G | E | G# | F | A | F# | Bb | G |
| Bb | G | B | G# | C | A | C# | Bb | D | B | Eb | C |
| Eb | C | E | C# | F | D | F# | Eb | G | E | G# | F |
| G# | F | A | F# | Bb | G | B | G# | C | A | C# | Bb |
| C# | Bb | D | B | Eb | C | E | C# | F | D | F# | Eb |
| F# | Eb | G | E | G# | F | A | F# | Bb | G | B | G# |
| B | G# | C | A | C# | Bb | D | B | Eb | C | E | C# |
| E | C# | F | D | F# | Eb | G | E | G# | F | A | F# |
| A | F# | Bb | G | B | G# | C | A | C# | Bb | D | B |
| D | B | Eb | C | E | C# | F | D | F# | Eb | G | E |
| G | E | G# | F | A | F# | Bb | G | B | G# | C | A |
| C | A | C# | Bb | D | B | Eb | C | E | C# | F | D |

FIG. 7

MUSICAL-INSTRUMENT CONTROLLER WITH TRIAD-FORMING NOTE-TRIGGER CONVERGENCE POINTS

BACKGROUND OF THE INVENTION

The present invention relates to musical instruments and, more particularly, to an array keyboard controller. A major objective of the invention is to provide a flexible yet compact musical-instrument controller that permits convenient fingerings of common note combinations.

Developments in electronic music synthesis have open up a wide palette of new and intriguing timbres, as well as made it possible to emulate almost any acoustic instrument. However, controllers for accessing these new sounds have, for the most part, been limited to emulating acoustic instruments, with piano-style keyboards dominating synthesizer applications.

With rare exception, piano keyboards have 88 keys for playing a 7⅓ octave range. A vast quantity of music has been written for the 88-key piano. Understandably, 88-key synthesizer controllers are appealing as they allow access to this music, plus the ability to vary the timbre with which music is played. Pianos, of course, are not portable instruments, but some portable 88-key synthesizer controllers are available. Still they are heavier and more bulky than desired for those who would take their music with them.

Arranger keyboards are piano-style keyboards that use chord recognition in generating auto-accompaniment patterns. The most popular arranger keyboards have 61 keys, typically divided so that an about 1.5-octave lower range is used for chord recognition, while an about 3.5-octave upper range handles melody and other parts. While the available note range is more limited than that of a conventional keyboard, the patterns can include notes outside the nominal keyboard range, permitting the full piano-keyboard range to be sounded.

In addition, arranger keyboards often simplify the fingering of note combinations. For example, many arranger keyboards allow certain 3-note chords (typically major triads) to be triggered with one finger by hitting the root in the chord zone. In many cases, minor chords can be triggered using only two fingers (e.g., hitting the root and the minor).

On the other hand, arranger keyboards pose a problem when a player wants to intermix single-finger chord triggering and base notes in the chord zone. Typically, the musician must resort to turning single-finger chords off (if this is possible) and playing three-note chords. A similar problem exists when the player wants to play intervals in the chord zone without triggering a chord change. Modern chord recognition schemes have various ways of dealing with these limitations, but all make assumptions concerning what the musician "probably" wants to do. When the assumption is wrong, the results are typically undesirable. In addition, there are times when most players want to play without auto-accompaniment—but, then, the missing (88-61=) 27 keys often make a difference. Furthermore, while 61-keys makes for a smaller form factor than 88-keys, it is still larger than desired for portability.

Array keyboards provide a large number of keys in a relatively compact arrangment. For example, all the notes in a piano and then some can be represented in a 12"×8" array of 1" inch square keys. Obviously, this addresses issues of portability, but there is a challenge to arrange the keys for optimal playability. For example, if each row of the array is a separate octave, so that each column contains octave transpositions for a given note, (e.g., $A^{-4}$, $A^{-3}$, $A^{-2}$, $A^{-1}$, $A^{0}$, $A^{+1}$, $A^{+2}$, and $A^{+3}$) certain familiar note combinations can be difficult to finger.

The Z-Board available from Starr Labs (www.starrlabs.com) arranges array rows in fourths, in a manner similar to convention guitar tuning (which uses four fourths and one major third). In fact, Starr Laboratories also advertises a G-Board that uses standard guitar tuning. Conveniently, common guitar-like fingerings are possible. However, this 12-row by 23-column array does not extend over the entire conventional piano range. While it can be retuned to allow a wider range of pitches, the convenient and familiar 4ths fingerings are sacrificed in the process.

Starr Labs also discloses "Wilson Generalized Keyboards" for microtuning applications. One board is a 90×8 array of hexagonal keys, while a smaller version sports 48×6 keys. A tuning for conventional western tonalities is not disclosed at the website. These keyboards are not compact, with the smaller being comparable to a piano in keyboard length.

There are also some array keyboards systems that depart from the convention relationship between space and pitch that typifies most keyboards. The Chordboard CX10 (www.) offers easy chord selection and transposition from one key to another. While the Chordboard seems well suited for arranger-style (chord and melody) playing, it does not seem well suited for more free-form styles. In a sense, the chord emphasis becomes as much a limitation as it is an aid. The Chordboard is about 1.25 meters (49") long, about the same as a five-octave keyboard.

The "Samchillian Tip Tip Cheree" relatistic keyboard provides a large melodic given the number of keys used. However, it is not well suited for pieces that would normally require two hands to be played on a piano. Both the Chordboard and the Relativistic keyboard impose a learning curve as they weaken the intuitive relationship between space and pitch.

What is needed is a compact musical-instrument controller that provides for a full-piano note range, and provide convenient fingering of common chords, intervals, and single notes throughout the note range.

SUMMARY OF THE INVENTION

The present invention provides for an array of note triggers that define triads at (at least some) points where three or more note triggers converge. The triads each include a major third interval and a minor third interval; both major and minor triads are provided for. For example, if note triggers that are assigned notes C, E, and G, respectively converge, they define a C major triad at the convergence point. Preferably, one note trigger will converge in a major triad at one convergence point and in a minor triad at another convergence point. Where four or more note triggers converge, more than one triad can be formed at that convergence point. In accordance with a further aspect of the invention, a triad can be triggered at a convergence point. Furthermore, third and fifth intervals can be triggered at an extended boundary. The invention provides for rows or columns of note triggers arranged in fifths so that a row or column covers an entire circle of fifths.

By placing note triggers collectively defining thirds and fifths near each other, the invention makes it convenient to trigger these common note combinations. However, the invention further provides for triggering the boundary segments and vertices for single-finger triggering of useful intervals and chords. This maximizes the convenience of playing thirds, fifths, and major and minor chords without depriving the player of access to the individual notes that make up these note combinations. For example, a player can trigger a vertex to play a triad (e.g., C-E-G) and trigger a key to trigger a single note (e.g., Bb) to trigger a four-note chord (e.g., C7). In contrast, conventional arranger keyboards typically impose a choice between single-finger chords and individual access to the notes that make up these chords.

In a more specific aspect, the invention provides a hexagonal array of hexagonal note triggers. In a hexagonal array, successive rows are staggered and successive columns are staggered. In the inventive hexagonal array, consecutive note triggers in a row are adjacent and form fifths intervals; while consecutive note triggers in a column are not adjacent (in the note array) and form chromatic (semi-tone) intervals. Accordingly, there are diagonally adjacent pairs of note triggers with one from each of two consecutive rows. In this case, diagonally adjacent pairs form third intervals. Thus a given note trigger can define fifths above and below in the same row, major third above and a major third below notes in the row above, and a minor third above and a minor third below notes in the row below. For example, a hexagonal C note trigger can be adjacent to and collectively surrounded by: E, G, Eb, Ab, F, and A.

In this specific aspect, a chromatic progression proceeds up each column, spanning a third and then wrapping to the next column. The columns alternate between spanning minor thirds and major seconds (whole-tone intervals); there is also an additional semi-tone interval involved in each wrap. In accordance with a more specific aspect of the invention, additional rows can be added to duplicate notes near the top or bottom of the array to provide alternative fingerings for certain note combinations.

In another aspect, the invention provides a rectangular array in which columns and rows are not staggered. Columns progress in fifths, while rows progress in interleaved thirds (A-C-A#-C#-B-D). In this array, four keys meet at a vertex to define Major M7 chords (e.g., C-E-G-B) and minor m7 chords (e.g., C-Eb-G-Bb). The invention alternatively provides for interpreting vertex triggers as four-note chords or as the base triads (e.g., C-E-G and C-Eb-B). Other embodiments of the invention provide for other types of arrays and other trigger geometries.

The present invention further provides for continuous controllers in the array area. Continuous motion from one trigger to the next does not activate the second trigger, but is interpreted as a control change for some parameter associated with the first trigger. For a two-dimensional array, this control can have two dimensions in the plane (or surface) of the array. To avoid limitations associated with notes near array boundaries, monotonic control changes can proceed as a motion caroms off an array perimeter. The availability of continuous motion control can apply to all or just some of the note triggers, interval triggers, and chord triggers.

The invention provides for a keyboard that is more compact than a piano or piano-style keyboard with the same note range. A full 88-key range is achieved with less than a half the length of a piano-style keyboard with full-size keys. This not only makes the present keyboard more portable, but makes it possible to finger note combinations that are not feasible using a typical piano keyboard. An average-sized hand can readily span two octaves, whereas one octave is typical with a piano. The invention makes it easier to play simple passages as intervals, and chords can be triggered with one finger. In addition, complex passages are also facilitated since, while one finger is triggering a combination of notes, the other fingers of a hand are available to play other notes. For example, some six-note chords can be played with two fingers.

The invention provides additional advantages over an arranger-style keyboard when it comes to triggering patterns based on chord recognition. The present invention allows both major and minor chords to be played with one finger, whereas a typical arranger only allows major chords to be triggered with one finger. Furthermore, the present invention allows single bass notes and chords to be intermixed freely, whereas a typical arranger keyboard does one or the other, but not both concurrently in the same zone. Finally, the invention allows for interval triggering, e.g., a single-finger C-E interval, whereas arranger keyboards do not permit this.

When compared with array keyboards, the present invention provides a large pitch range without excessive redundancy. For example, in the Starr Laboratories Z board, 276 keys cover fewer than 88 notes. The Z board can be returned to cover a wider range, but then fingering becomes problematic. In addition, prior-art keyboards do not provide integrated (without special programming) triggering of intervals and notes. When compared with the Chord Board and the Relativistic keyboard, the present invention provides a full pitch range and easy chord triggering without deviating from the intuitive relationship between pitch and space. The power and flexibility of the invention are further enhanced using associated skid, slide, strum, and pad controls, as is apparent from the description below with reference to the following drawings.

BRIEF DESCRIPTION OF THE DRAWINGS

FIG. 7 is a schematic diagram of a rectangular key array in accordance with the present invention.

DETAILED DESCRIPTION

Figure 1:
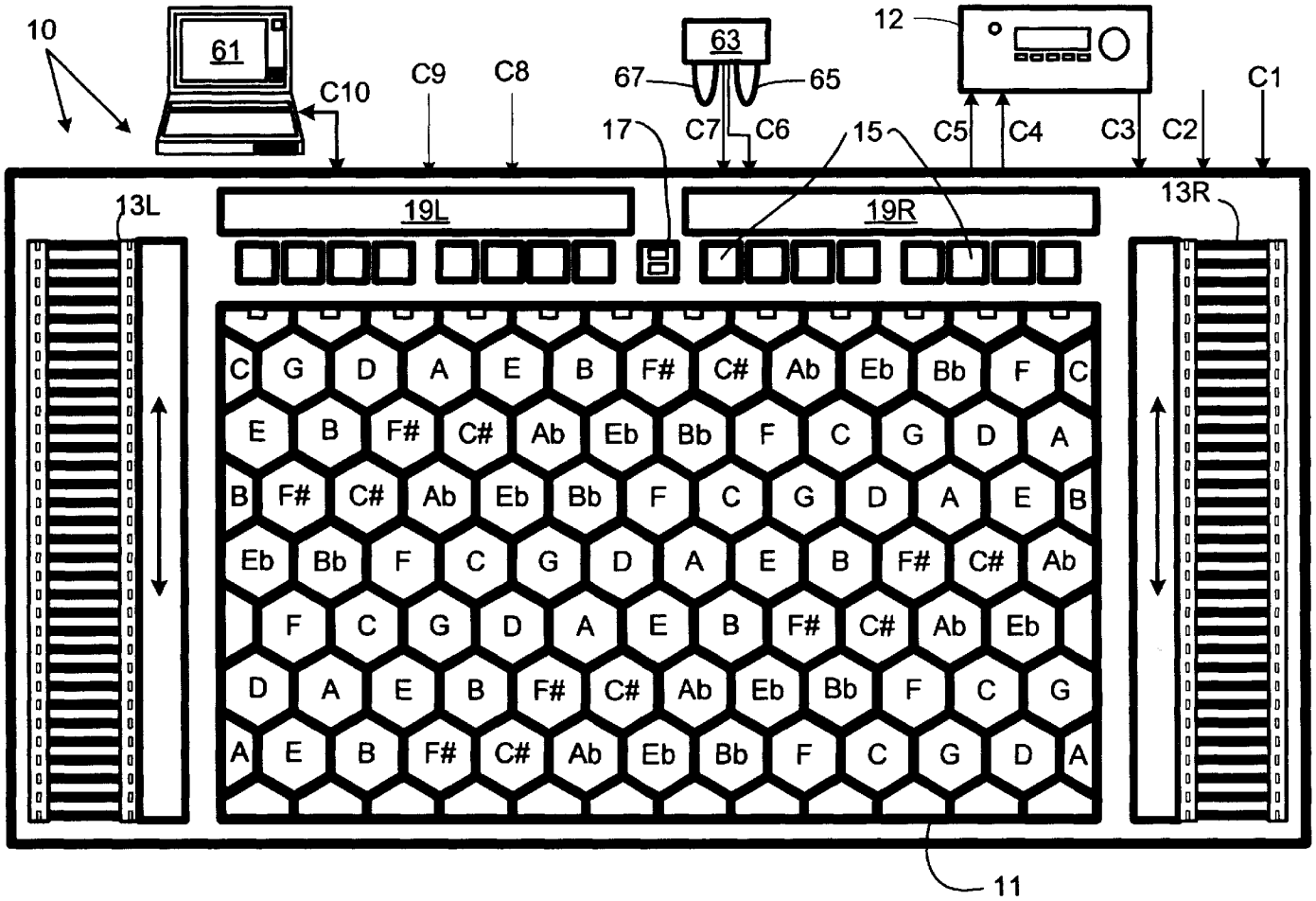
FIG. 1 is a schematic diagram of a musical instrument controller in accordance with the present invention.

A MIDI controller 10 for controlling a MIDI sound module 12 comprises an array keyboard 11, two wing control clusters 13L and 13R, sixteen pad controllers 15, and a "load" button 17, shown in FIG. 1. In addition, there are left and right LCDs 19L and 19R at the top of controller 10. In an alternative embodiment, controller 10 extends to the sides to provide hand rests and guides for a musician playing wing controller clusters 13L and 13R. Immediately below, a normal "fire" mode is described; subsequently an alternative "load" mode is discussed that provides for on-board programming and some alternative playing techniques.

Figure 2:
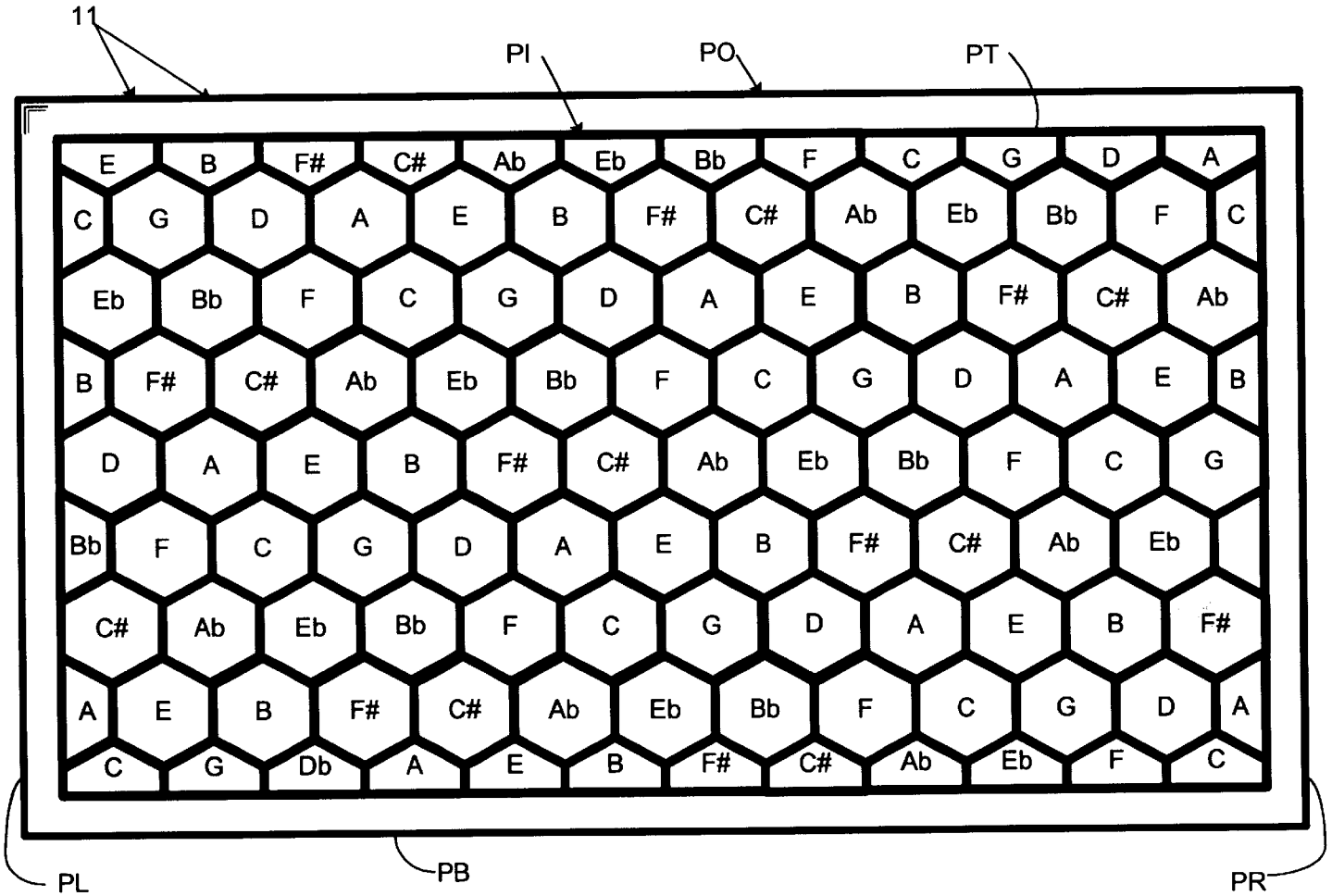
FIG. 2 is a schematic diagram of a key array of the controller of FIG. 1.

Array keyboard 11 is shown in greater detail in FIG. 2. Array keyboard 11 comprises seven rows of hexagonal keys; four of these rows begin and end with semi-hexagonal keys. Herein, the rows are identified by their respective leftmost key; from bottom to top, the rows are A, C#, Bb, D, B, Eb, and C. Additionally, there is a top row of semi-hexagonal keys (beginning with E), and a bottom row of semi-hexagonal keys (beginning with C). Adjacent rows are offset from each other by half a hexagon. The array also has 25 columns; adjacent columns are offset from each other by a half hexagon.

The hexagonal keys are 2.5 cm (about 1") per side. To accommodate different hand sizes, other embodiments use 2.0-cm-per-side and 3.0-cm-per-side keys. Including margins, the illustrated array keyboard 11 is about 60 cm by 40 cm (24"×16"), and controller 10 is about 96 cm by 40 cm (32"×16"). These dimensions correspond to a three or four octave piano-style keyboard, while providing a full seven-and-a-third-octave range.

Within a column, the notes ascend by semitones. Thus, the left-most column has A-Bb-B-C, as does the right-most column. Adjacent columns provide thirds intervals for each other. Thus, the second column provides a C and a C# adjacent to the A of the first column; in other words two notes defining a semitone interval are separated by a note that forms a third with each of the other notes. The third column provides thirds intervals for the second column. The third column also provides fifths intervals for the first column. Likewise, pairs of columns separated by one column provide adjacent fifths. As a result, each row corresponds to a full circle of fifths.

The lowest note represented on array keyboard 11 is the A at the lower left, while the highest note is the C at the upper right. These correspond to the high and low notes of a standard piano keyboard. So array keyboard 11 covers the range of a piano keyboard. More or fewer columns can be used to increase or decrease this range. The seven rows with hexagons have a total of 88 keys to match the standard piano keyboard. The top and bottom rows of semi-hexagons provide some redundancy to aid difficult fingerings.

Figure 3:
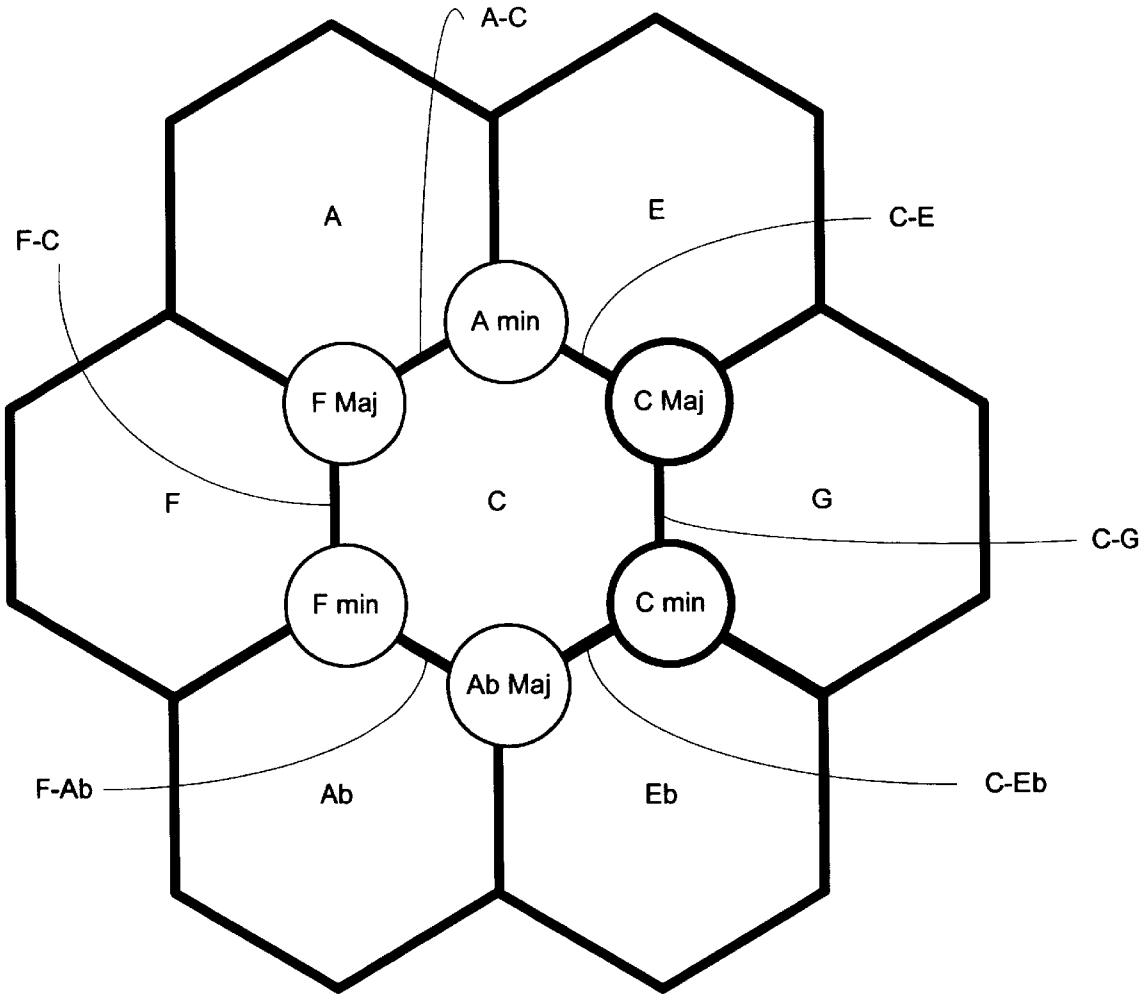
FIG. 3 is a schematic diagram of a group of seven hexagonal keys of the array of FIG. 2 showing locations for triggering intervals and triads.

Any note represented on the array can be played by depressing the corresponding key. Each key is initial-touch (e.g., velocity) sensitive and after-touch (e.g., key-pressure) sensitive so that the dynamics of percussion, wind, and string instruments can be emulated. In addition to providing for single-note triggering, the invention provides for interval triggering by depressing the line-segment boundaries between notes. All the full hexagon keys, have six such boundaries, so six intervals can be triggered. The six intervals A-C, C-E, C-G, E-Eb, F-Ab, F-C, and F-A that can be triggered by depressing the boundaries of a C key are shown in FIG. 3. The intervals are intuitive in that they correspond to the two notes on either side of the boundary.

Depressing a convergence point, in this case, where three hexagons meets triggers a triad chord. For each such vertex, there is a root note, a fifth, and a third. If the third is in the row above the root and the fifth, the third is a major third; if the third is in the row below the row with the root and the fifth, the third is a minor third. The six triads formed at the six vertices of a C key are shown in FIG. 3. Note the C major triad and the C minor triad to the right of the C key.

This hexagonal arrangement of 3rds makes it easy to play third intervals, perfect fifths, and major and minor triads. Yet single notes are equally accessible without any change of mode. More complex combinations of notes can be fingered; for example, an F Major 9 can be triggered by depressing the F-A-C vertex and the G note (in FIG. 3).

The keys are position and motion sensitive. This sensitivity is achieved by tracking motion within triggers and detecting continuities when an adjacent trigger is contacted. Alternatively, a membrane of touch sensitive material can be placed over the entire surface of keyboard array 11 to provide this sensitivity. One embodiment of the invention uses Kinotex™ available from Tactex Controls, Inc., Canada, to provide the desired pressure, contact, and motion sensitivity. Even in normal mode, if a key is triggered and a finger moves from this key in a given direction, this motion is interpreted as a control change. Even if the motion carries onto another trigger, the motion is treated as indicating a modulation associated with the original contact. Typically, the sound associated with the trigger reached by continuous motion is not sounded. Typically, motion from the trigger initially contacted to another trigger is treated as a modification of the volume, pitch, or other parameter as applied to the note, interval, or triad, associated with the original trigger.

When the initial trigger point is a note, movement in either of the row or column dimensions affects pitch, with aftertouch controlling volume or expression. Arrows A01 and A02 emanating from the C note in FIG. 4 indicate the positive pitch directions. Movement in the opposite directions causes negative pitch changes. If the tone being generated is composite, the vertical dimension can control the pitch of one component, while the horizontal dimension controls the pitch of the other component. This feature can be used to generate chorus and discordant effects.

Figure 4:
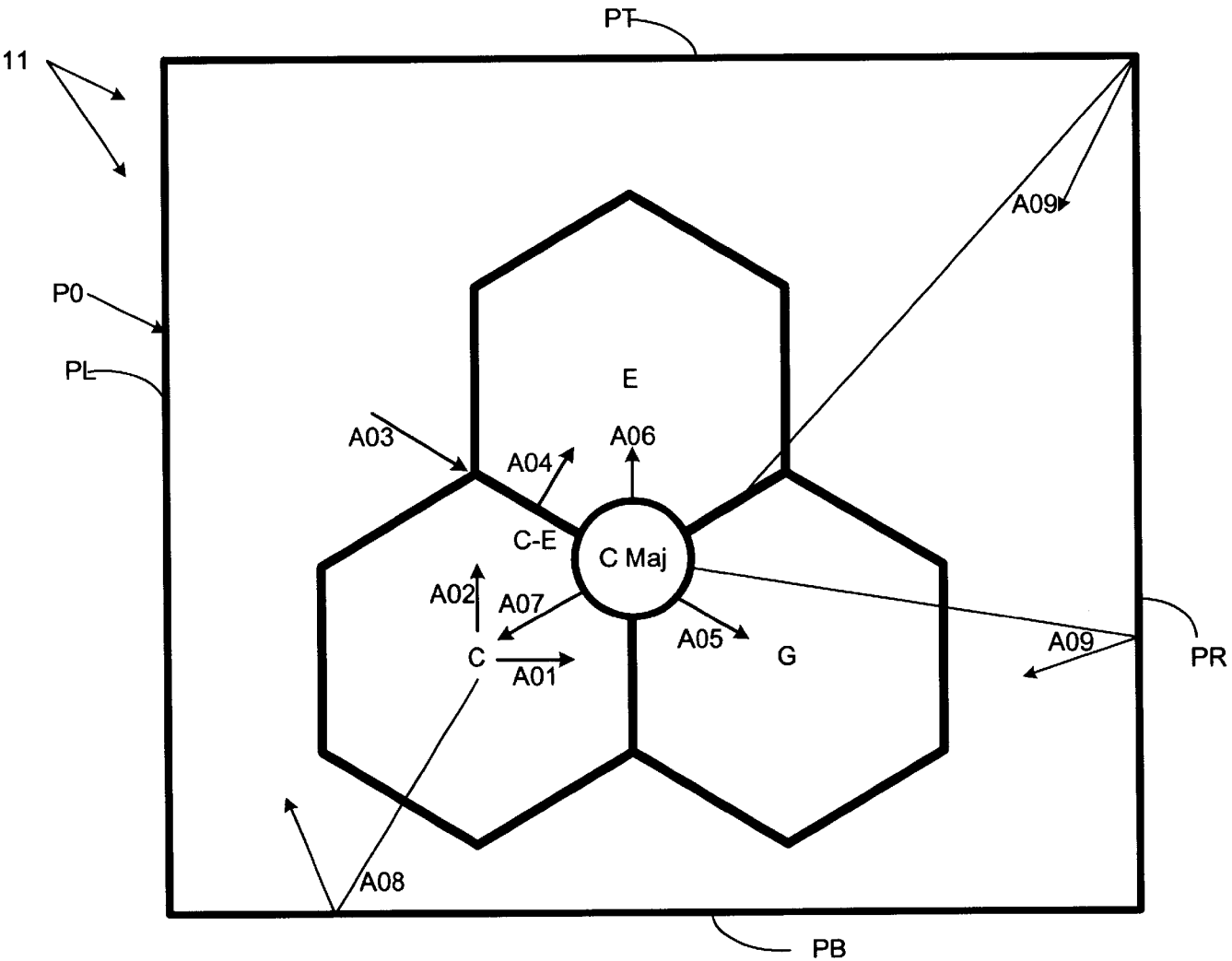
FIG. 4 is a schematic diagram of a group of four hexagonal keys of the controller of FIG. 2 showing motion vectors for continuous controllers.

When the initial trigger point is an interval, movement along or parallel to the interval segment induces pitch variation, with the positive pitch direction being toward the right (or up for a vertical segment) as indicated by arrow A03 pointing toward one end of interval segment C-E in FIG. 4. Movement orthogonal to an interval segment, such as indicated by arrow A04 from segment C-E toward note E in FIG. 4, changes the relative volume or "mix" of the interval components. Thus, movement in the direction of the arrow from interval C-E toward the E increases the prominence of note E in the interval C-E.

When the initial trigger point is a triad, movement toward one of the triad notes increases its prominence in the mix. Thus, in FIG. 4, arrow A05 from the C Major triad toward the G increases the prominence of G in the triad. Motions in the directions of arrows A06 and A07 from the C Major triad toward the C and E notes respectively increase their relative volumes. The overall level of the triad is controlled by an envelope programmed into the sound and aftertouch.

Control motions can proceed into a perimeter PE, although, in the illustrated embodiment, they cannot begin there. Perimeter PE has an inner boundary PI and an outer boundary PO. Perimeter PE also comprises a top leg PT, a bottom leg PB, a left leg PL, and a right leg PR. In the illustrated embodiment, the perimeter does not contain triggers. However, contacting inner perimeter PI can trigger notes and intervals at the boundary of the array. In an alternative embodiment, the perimeter contains triggers and controllers, but these do not have the benefit of motion control.

Controller motion can "carom" off outer perimeter PO to provide continuous control at the keyboard boundaries. If a control motion reaches a side of perimeter PO, the polarity of the corresponding movement direction reversed. A smoothing algorithm smoothes velocity changes around the point of reversal to avoid sonic glitches. Keyboard array 11 is recessed about 2 mm relative to outer perimeter PO, which thus provides the kinesthetic feedback of a wall for the carom action.

For example, the motion indicated by arrow A08 yields a continuous lower of pitch in two dimensions; after caroming off of bottom side PB, the vertical pitch control is treated as though its motion were continuing downward. Likewise, the motion indicated by arrow A09 corresponds to a continuous increase in the volume associated with the G-note in the C major triad despite the fact that the motion proceeds in the opposite direction after caroming off of right side RP. When the carom is off a side, the orthogonal control direction is unaffected. However, bouncing off a keyboard corner reverses the polarity of both motion directions; thus the motion indicated by arrow A10 results in a polarity reversal for both orthogonal motion components. Note that the use of caroming allows the full length and width of keyboard array 11 to be used for high-precision per-key effects.

The standard MIDI specification provides for only one per-key continuous controller, namely, key-pressure. However, the present invention provides for up to three dimensions per key to be controlled. Controller 10 of FIG. 1 uses dynamic channel allocation to make channel controllers simulate continuous key controllers. Each note that is sounding is assigned to a different channel from a group of channels, typically assigned the same sound program. Thus, only one note sounds per channel and the channel controller affects only that note. The algorithm for dynamic channel allocation is basically the same as that for dynamic voice allocation used in many synthesizers to overcome polyphony limitations.

Alternative embodiments overcome the single per-key controller limitation of MIDI in other ways. Accordingly, the present invention provides for a modification of the MIDI spec in which poly pressure values are divided into three ranges, one range for each of the three dimensions (pressure, row movement, column movement) used by the embodiment of FIG. 1. In alternative embodiment, a non-MIDI protocol is used that provides for three dimensions of continuous control per key.

Drum pads 15 trigger drum-kit sounds by default. However, they can be reprogrammed to generate other drum-kit sounds, sound effects, notes, intervals, chords, sequences, and patterns. This programming can be done externally, but can also be done to a limited extent using on-board programming as discussed further below. In an alternative embodiment, the drum pads are integrated into the upper leg PL of perimeter PE.

Figure 5:
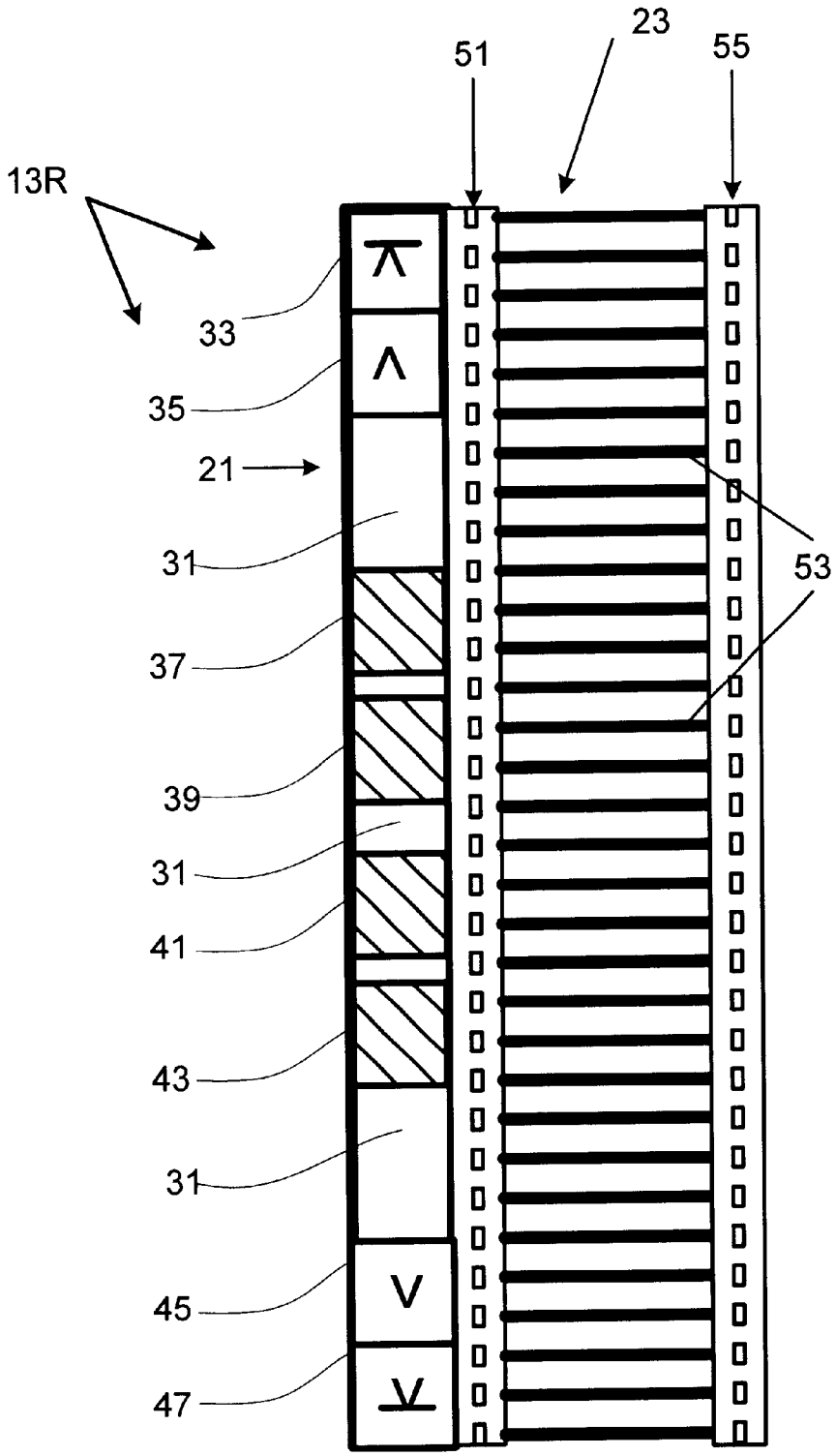
FIG. 5 is a schematic diagram of a wing control cluster of the controller of FIG. 1.

Wing control clusters 13L and 13R are mirror images of each other, so the following description of right-wing control cluster 13R also applies to left-wing control cluster 13L. Right-wing control cluster 13R, shown in greater detail in FIG. 5, has a slide controller 21 and a strum controller 23. Slide controller 21 is a basic ribbon (one-dimensional membrane) controller with "soft" buttons defined on a slide body 31. From top to bottom, the soft buttons are: maximum button 33, increment button 35, top controller select button 37, upper controller select button 39, lower controller select button 41, bottom controller select button 43, decrement button 45, and minimum button 47.

Initially contacting one of the select buttons, 37, 39, 41, 43, selects a controller, such as master volume, tempo, channel volume, channel modulation, channel pitch, etc. for a given channel or set of channels. Subsequent movement along slide body 31 changes the value for the selected controller. The entire slide body 31, including areas covered by the other select buttons, can be used for that controller until the finger is lifted. In this way, slide 21 provides convenient access to four different continuous controllers. Typically, upward movement increases the value and downward movement decreased the value, but this is programmable. If the initial contact with slide 21 is not at a select button, then a default or the most recently selected controller is selected.

Increment button 35 increments the value of the selected controller, while decrement button 45 decrements the selected controller. Maximum button 33 sets the active controller to its maximum value, typically 7F, while minimum button 47 sets the active controller to its minimum value, typically 00; if the polarity for slide 21 is reversed, so are the roles of the minimum, maximum, increment and decrement buttons. Activating the maximum and minimum buttons 33 and 47 concurrently sets the controller value to a default or middle value. In an alternative embodiment, slide controllers are built into the right leg PR and left leg PL of perimeter PE.

Next to slide is an "inner" column 51 of LEDs that indicate the MIDI value transmitted by the active controller of slide 21. There are thirty-two four-segment LEDs in this inner column 51, allowing all 128 of the typical MIDI controller values to be represented.

Strum controller 23 has 32 ribs 53 that can be used to strum or arpeggiate whatever is being played on the keys. By default, the right arpeggio strum controller 23 note combinations played on keyboard 11, while the left strum controller strums through scales derived from notes played on keyboard 11. However, the use of the strum controllers is programmable. For example, they can be programmed to correspond to an arbitrary pattern (transposed as a function of the active keys) that is stepped through, either manually, or using an external sequencer or pattern generator.

Each rib 53 is direction and 2-position sensitive. In other words, upward and downward strums can be differentiated, and the inner and outer halves of each rib can be differentiated. This allows for 128 different triggers. Normally, the four actions for a rib are not differentiated, but they can be programmed differently. For example, upward and downward motions can trigger different samples, or different notes (as when a harmonic scale is being triggered). The ribs being activated can be indicated by inner LED column 51. An outer 32-LED column 55 is used to indicate the state of various secondary functions assigned to the ribs. Switching between toggle states can performed in "load" mode, described below.

Controller 10 has several connections including a power input C1, two MIDI inputs C2 and C3, two MIDI outputs C4 and C5, two foot switch inputs C6 and C7, a volume pedal input C8, a breath controller input C9, and a USB port C10, as shown in FIG. 1. MIDI outs C4 and C5 can be connected to a single module 12 that provides for 32-channel operation (such as a Roland XV-5080). MIDI IN C2 is for use as a control input, e.g., from a Yamaha WX5 wind controller, a Roland AX-7 strap-on keyboard controller, or a Yamaha MFC10 foot controller. MIDI IN C3 is used to route MIDI outputs from module 12 to a computer 61 via USB connection C10. Footswitch input C7 is for a sustain-pedal input, while footswitch input C8 is for a load-pedal input that duplicates the operation of load button 17. Preferably, a dual-pedal 63 provides both a sustain pedal 65 and a load pedal 67. Input C8 accepts a volume pedal, while input C9 accepts a breath controller, such as a Yamaha BC-1. The breath controller works with a high-note priority scheme to provide dynamic control emulating a wind instrument.

An alternative wing-control cluster comprises a 128-rib "skid" controller and a 33-rib strum controller. The strum controller can distinguish up and down motions. To the inside of the skid controller is a 128-segment LED column; to the outside of the skid controller is a 32-LED column. Each LED of the latter column is located between a pair of ribs of the strum controller. A third column of 33-LEDs is to the outside of the strum controller; each LED of the third column is adjacent a rib. Note that the top rib of the strum controller is shortened and shifted to the inside.

The skid functions much like a multi-slide controller. The current controller is indicated by the illumination of an LED of the LED middle column, while the current value of that controller is indicated by illumination of an LED of the inner column. Changing the value of the current controller is effected by moving a finger vertically along the skid. Relative value changes are typically implemented; however, absolute changes can be accomplished simply by starting next to the illuminated LED of the middle column. Once the musician has moved the controller value near a desired value, moving a finger to the strum controller without losing contact with a rib shared by the skid and the strum controller. This is another example of muting the trigger of a trigger controller when a trigger area is entered by a continuous motion. "Continuous" herein is contrasted with "discrete", a distinction with thresholds definable in software.

Thirty-two controllers can be assigned to respective LEDs of the middle column. Depressing the skid next to a middle-column LED selects the corresponding controller as the active controller. The LED next to that controller illuminates, while the LED next to the previously active controller turns off. Likewise, the present value of the new controller is indicated by a newly illuminated LED of the inner column, while the LED associated with the present value of the previously active controller turns off (unless the values of the two controllers happen to be the same.) Note that the assignable controllers can provide bank, program, and registration selection.

Various toggle and other switch functions can be assigned to outer-column LEDs. These switches can be activated in load mode by contacting the corresponding rib of strum controller. In addition, switch can be performed automatically by selecting a registration using skid 81.

Figure 6:
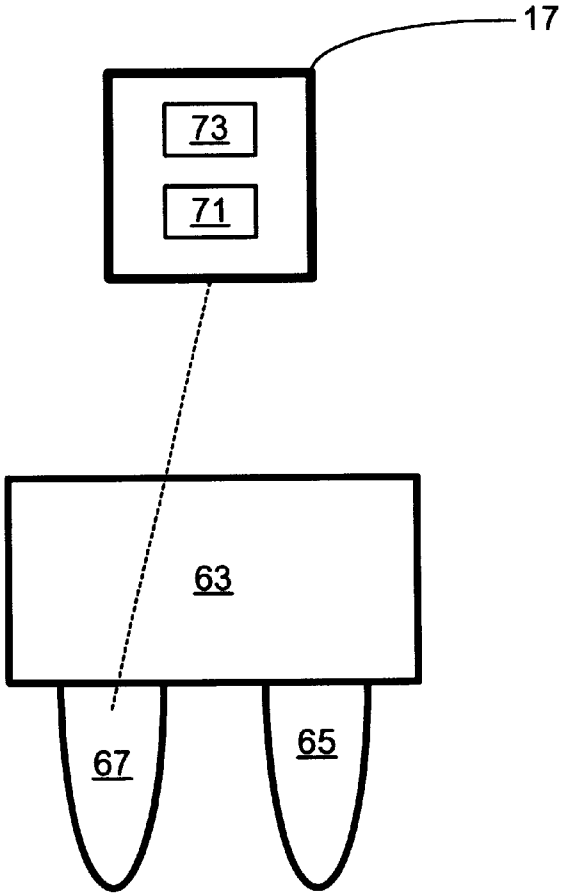
FIG. 6 is a schematic diagram of a load button of the controller of FIG. 1 and a dual foot pedal connects with the controller of FIG. 1.

Controller 10 is designed to be programmed using external computer 61 connected via USB port C10. However, limited programming can be achieved in a "load" mode. Load mode can be initiated from fire mode by momentarily depressing either load button 17 or load pedal 67, shown in FIG. 6. Load mode can be "held" by holding load pedal down. Load mode can be "locked" by momentarily depressing either load button 17 or load pedal 67 twice in succession (i.e., without intervening contact with a trigger). If there is intervening contact with a trigger, a second momentary depression of load button 17 or load pedal 67 returns controller 10 to fire mode. In an alternative embodiment, the load function can be triggered from an upper leg of an array perimeter.

The first trigger activated after load mode is entered does not trigger a sound. This allows every trigger of controller 10 to be used to begin a load sequence for programming and for use in alternative playing techniques. The load sequences and the actions they implement are entirely programmable. Since controller 10 has over a thousand triggers, and since each sequence can use two or more of these triggers, there is capacity for deep and flexible programming. It is not possible to describe all the possible uses for this depth and flexibility, but some of the contemplated uses are set forth below.

If a hex key is activated immediately after load mode is activated, the corresponding note is not sounded; likewise, is a hex segment or vertex is triggered, the corresponding notes are not sounded. Instead, a series of keys, segments and vertices can be pressed so that all the notes represented sound at once when the load sequence is terminated. This allows complex chords to be fingered over time and sounded when desired (either all at once or as strummed).

Exiting load mode and then triggering a note terminates a load sequence. If load mode is held or locked, a load sequence can be terminated by hitting a note twice (either individually or as part of an interval or triad). If a note is hit twice in succession, it is transposed up an octave. If an octave shift is not desired, the duplicated note triggerings can be separated by an intervening note triggering (or by exiting and reentering load mode). The transposition feature allows chord inversions to be easily triggered. Also, certain note combinations can be triggered in an alternate (e.g., more central) keyboard location. This can be convenient as an alternative to using the carom feature for motion control.

Instead of terminating a keyboard sequence with note duplication, the sequence can terminate by hitting a pad. This assigns the played note or note combination to the pad. The keyboard can be assigned to a drum-kit channel before assigning a note to a pad; in this way, a drum-kit element can be assigned to a pad.

If, after load mode is activated and a keyboard trigger is activated, the next action is a motion, keyboard array 11 then acts as a cursor control for computer 61. The two dimensional array provides relative 2-D cursor motion. At any point, a hex key to the left serves as a left mouse button, while a hex key to the right serves as a right mouse button.

If the first trigger activated in load mode is a strum rib 53, a switch function secondarily assigned to that rib can be activated. In this case, the adjacent light of LED column 55 can be illuminated or turned off to indicate the state change. Another secondary use of a rib is to select a continuous controller for control by slide 21. While the rib is depressed the assigned continuous controller is controlled by movement along slide 21. Alternatively, the rib can be touched to select the continuous controller and then a controller select button (37, 5 39, 41, 43) can be selected; this sequence assigns the controller associated with the rib to the contacted soft button (overwriting its previous assignment).

Depending on programming, pads 15 have many uses in load mode. In addition to being targets to which sounds can be assigned, they can serve for MIDI channel selection or for numeric entry, e.g., for single or double-digit hex entry.

The musician can determine at a glance the current mode of controller 10 by looking at LEDs 71 and 73 on load button 17 (shown in FIGS. 1 and 7). LED 71 is on when load mode is active and off when fire mode is active. LED 73 is on when load mode is held (by continually depressing foot pedal 67) or locked (by double depressing pedal 67 or load button 17). When a load sequence auto-terminates, LED 71 turns off.

However, if load mode is held or locked (LED 73 is on), turn off of LED 71 is momentary; LED 71 immediate re-illuminates to indicate a resumption of load mode.

In addition to initiating load mode, load button 17 is used to initiate power on and power off operations. Power on can be as simple as depressing load button 17 when controller 10 is off. To avoid accidental shutdown, turn off requires load button 17 to be depressed followed by simultaneous pressing of the leftmost and rightmost pads. For security purposes, the turn on sequence can be programmed, effectively password protecting controller 10.

A second key array is shown in FIG. 7. This is a 12-row by 15-column array of square keys. The columns are alternately "root" and "thirds" columns. In FIG. 7, the thirds columns are shown shaded, while the root columns are unshaded. This results in each row having alternating shaded and unshaded notes in FIG. 7. The unshaded notes of a row rise chromatically from left to right in each row; likewise, the shaded notes of a row rise chromatically from left to right. The pitches of the shaded and unshaded notes are offset so that each note is bounded by thirds. In particular, each root note is adjacent to a note a minor third above to the left and adjacent to a note a major third above to the right. Notes within a column progress upwards by perfect fifths.

Figure 8:
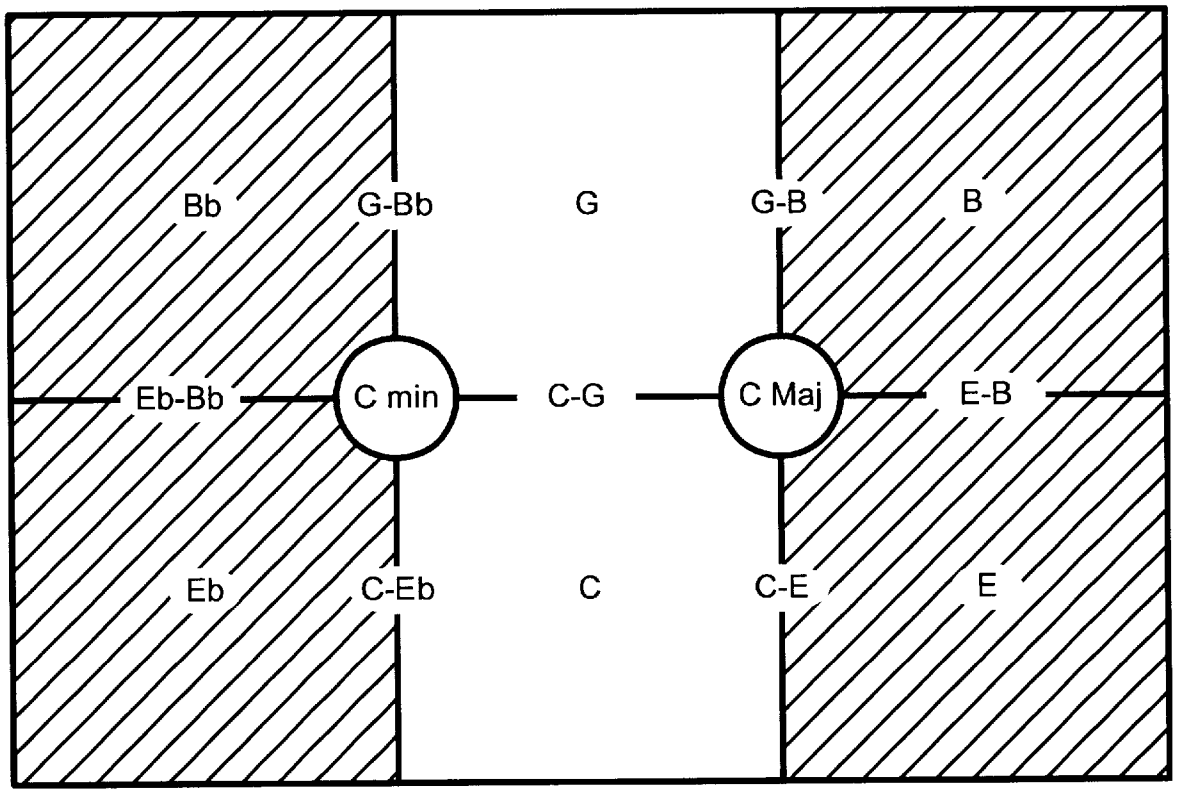
FIG. 8 is a schematic diagram of a group of six keys of the array of FIG. 8 showing the locations of interval and triad triggers.

Line segments play thirds and fifths as indicated in FIG. 8. The upper corners of each root note touch four notes so the seventh is ignored when sounding a vertex. In an alternative embodiment, all four notes at each vertex are sounded when the vertex is pressed.

Figure 9:
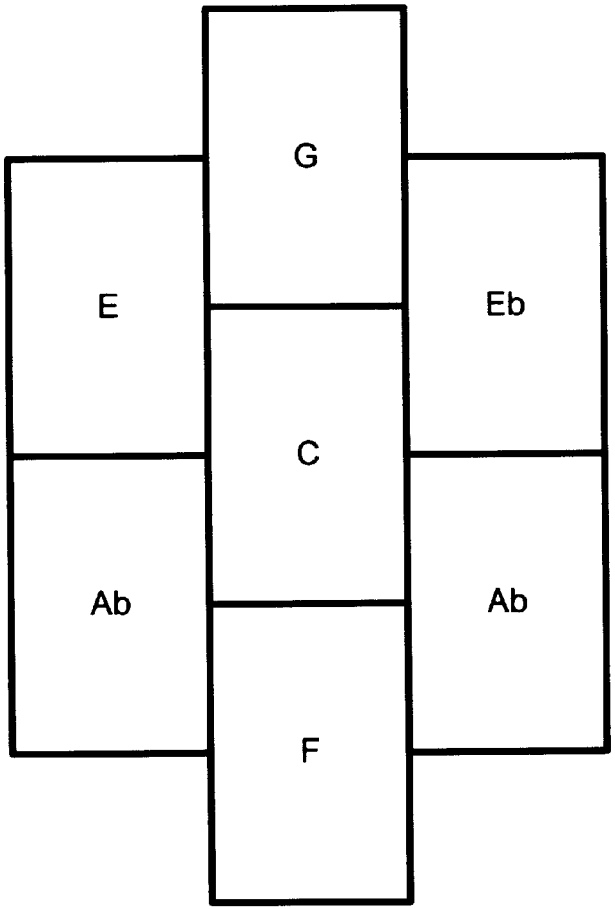
FIG. 9 is a schematic diagram of a group of seven keys of an offset column rectangular array in accordance with the present invention.

FIG. 9 shows a portion of a third embodiment with rectangular keys and staggered columns. This arrangement provides three-note convergence points that define triads as in the first embodiment. Note that each convergence point is adjacent to two vertices and a side, instead of only vertices as in the embodiments of FIGS. 1, 7, and 9. In fact, if one imagines that the rectangles are expanded mid-way up their heights, then the correspondence with the embodiment of FIG. 1 is apparent and the operation is similar.

Figure 10:
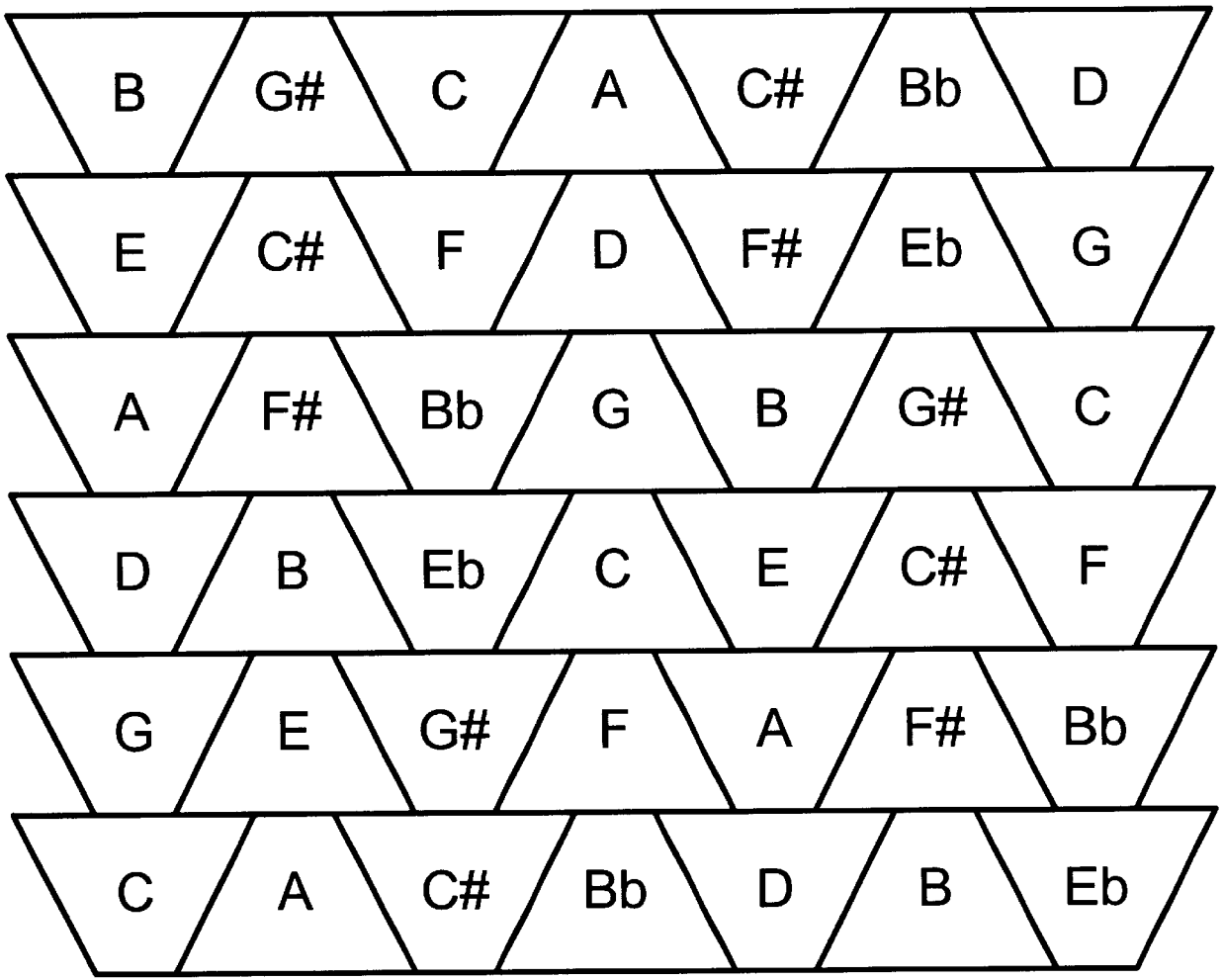
FIG. 10 is a schematic diagram of part of a key array with rows of trapezoids of alternating orientation.

FIG. 10 shows an embodiment in which the keys are trapezoidal, with the trapezoids of adjacent columns pointing in opposite directions. Again, the trapezoid vertices are three-note boundaries, making this embodiment suitable for triggering triads without resort to a special convention.

Figure 11:
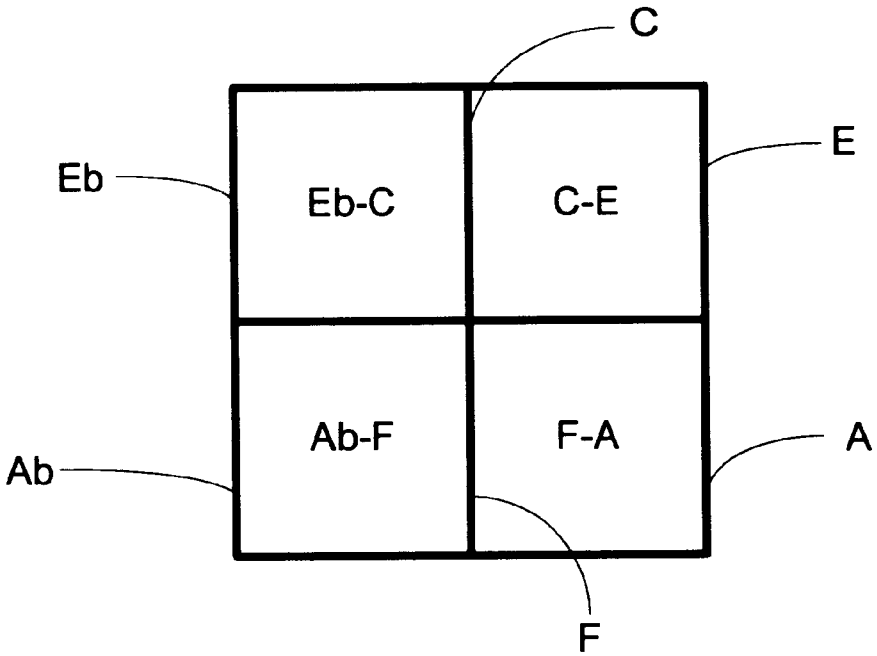
FIG. 11 is a schematic diagram of a four key group of a rectangular array in which the keys trigger intervals and the vertical lines trigger notes.

FIG. 11 shows a part of a rectangular array in which the keys trigger intervals and vertical boundaries trigger notes. The note triggered is the note in common between adjacent keys of the same row. This embodiment demonstrates that it is not necessary for the keys to trigger individual notes. In other embodiments, the keys trigger chords, and the vertices trigger notes.

Herein, a "triad" is a set of three notes that form two stacked third intervals. A major triad is such a set in which the two lowest notes form a major third interval and the two highest notes form a minor third interval. A minor triad is such a set in which the two lowest notes form a minor third interval and the two highest notes form a major third interval.

Depending on the array and note-trigger geometries, the convergence points can be adjacent to one or more note-trigger vertices. However, the invention does not require note triggers to have vertices; for example, the note triggers can be circular. Thus, the note triggers need not extend to the convergence points. On the other hand, the shapes that the note triggers would be if they were to fill the array area typically do have vertices near points of convergence. However, even for the array-filling shapes, note all note triggers at a convergence point have adjacent vertices. In addition, note triggers can converge along extended boundaries to define minor third, major third, and perfect fifth intervals. The extended boundaries are typically straight-line segments, but can be curved.

The phrase "note-trigger vertex" is a geometric concept. A note-trigger array defines a surface; each note trigger occupies some area on this surface. All points on the surface closer to one note trigger than any other note trigger are assigned to that note trigger. Thus, as the terms are used herein, even circular triggers have vertices once they are conceptually extended to fill the array surface. Depending on the embodiment, a note trigger vertex can be adjacent other note-trigger vertices or to a note-trigger vertex and a note-trigger side.

The term "adjacent" is defined geometrically herein. Note that all triggers, even nominally point triggers, have a non-zero area and thus include more than one point. Two triggers are adjacent if there is a pair of parallel line segments extending from one trigger to the other without intersecting a third trigger. Two note triggers are adjacent in an array if there are parallel line segments extending from one to the other without intersecting a third note trigger of the array. Two note triggers are adjacent in a row or column if there exist parallel line segments extending from one to the other without contacting another note trigger in the row. Also, a first trigger is "between" a second and a third trigger if two parallel line segments from the second to the third trigger pass through the first trigger.

Note that a conventional piano keyboard can be considered a two-dimensional array, with the white keys forming one row and the black keys forming another. A "G" note on the piano is adjacent four notes (F, F#, Ab, A), with which it forms semi-tone (minor $2^{nd}$) and whole-tone (major $2^{nd}$) intervals. No pair of adjacent notes on a piano define a third.

In conventional guitar tuning, the second (B) and third (G) strings are tuned a third apart. The strings do not qualify as "note triggers" as that phrase as used herein. However, G-boards and Ztars (available from Starr Laboratories) have note triggers that follow conventional guitar tuning and do qualify as note triggers. Thus, the G-board and Ztar have adjacent note triggers defining thirds intervals. However, no note on these instruments forms either a major or minor triad at a note trigger vertex. Furthermore, probably no string instrument has notes that form thirds with two notes that are a semitone apart.

The present invention can be used with an integrated sound module or an external sound generator. The sound generator can employ, electronic synthesis, including analog synthesis, analog modeling, subtractive synthesis, additive synthesis, frequency-modulation synthesis, physical modeling, sample playback, vector synthesis, wave sequencing, etc. One favored synthesis technique is differential physical modeling in which physical modeling is used to determine a differential from sample-based sound. This form of synthesis provides the accuracy of sample-based synthesis with the expression of physical modeling.

The present invention is not limited to driving synthesizers. For example, control data generated by a musical-instrument controller of the invention can be used to drive an acoustic instrument with a digital control interface, for example, a MIDI-driven acoustic piano.

In the illustrated embodiment, the note triggers are velocity and pressure sensitive switches; interval and chord information is derived from combinations of note triggers. Alternatively, separate triggers can be used for intervals and chords; the separate triggers can be raised or lowered relative to the note triggers. Also, the entire keyboard can have a position-sensing membrane (as on a touch-screeen), so that some or all of note, interval, and chord triggerings are based on membrane position data. The approaches can be combined, for example, by using mechanical note triggers with position sensing surfaces used to determine when intervals and chords are to be triggered. Also, none membrane sensors can be used with note triggers to determine when intervals or chords are to be activated.

As the foregoing embodiments demonstrate, the invention provides for a variety of array keyboards in which adjacent notes define major and minor thirds. Different key shapes can be used; rows and columns can be staggered or unstaggered. It is also possible to divide an array into zones to express different sounds. The strum controllers can trigger the same sounds as the keys or different timbres. In one configuration, keyboard array 11 plays piano sounds, left strum controller plays bass sounds, right strum controller plays guitar sounds, pads 15 play drums, and an attached breath controller can emulate a wind instrument and play a melody.

The invention provides for different array dimensions to accommodate smaller or larger ranges, greater or lesser redundancy, or microtonal applications. While the illustrated embodiments are all planar two-dimensional arrays, the invention provides for non-planar two-dimensional arrays and arrays of different dimensions. For example, a helically wound one-dimensional array can provide an analog to the array of FIG. 1 except that the columns are turns of the helix.

Also note that the keyboard array can be used without wing controllers, pads or other triggers. Also, it can be used with other controllers, including relative and chord-type controllers. These and other variations upon and modifications to the described embodiments are provided for by the present invention, the scope of which is defined by the following claims.

What is claimed is:

1. A musical-instrument controller comprising an array of note triggers assigned respective notes, first, second, and third of said note triggers converging at a first convergence point so as to define a triad, said musical-instrument controller further providing motion sensing so that when a force initially contacts said first note trigger and then executes a motion to said second note trigger while maintaining contact with said array, said motion causes a change in the value of a continuous controller and does not trigger a note associated with said second note trigger.

2. A musical instrument controller as recited in claim 1 wherein said array is two dimensional and said motion sensing senses motion in each of said array's dimensions.

3. A musical instrument controller as recited in claim 1 wherein said array has a perimeter, said motion sensing continuing monotonically when following a motion vector that reverses a motion vector component at said perimeter.

4. An musical instrument controller having an array of note triggers, said note triggers including first and second note triggers, said controller providing motion sensing so that when a force initially contacts said first note trigger and then executes a motion to said second note trigger while maintaining contact with said array, said motion causes a change in the value of a continuous controller and does not trigger said second note associated with said second note trigger.

5. A musical instrument controller as recited in claim 4 wherein said array is two dimensional and said motion sensing senses motion in each of said array's dimensions.

6. A musical instrument controller as recited in claim 4 wherein said array has a perimeter, said motion sensing continuing monotonically when following a motion vector that reverses a motion vector component at said perimeter.

* * * * *